270-53 SF
10/20/87 OR 4,700,940

United States Patent [19]

King

[11] Patent Number: 4,700,940

[45] Date of Patent: Oct. 20, 1987

[54] BLUEPRINT COPY COLLATING APPARATUS

[76] Inventor: Theodas C. King, Rte. 3, Box 343, Pittsboro, N.C. 27312

[21] Appl. No.: 880,715

[22] Filed: Jul. 1, 1986

[51] Int. Cl.[4] ..... B65H 39/05; B65H 39/11

[52] U.S. Cl. ..... 270/58; 271/288; 271/294; 271/221; 271/198; 355/14 SH

[58] Field of Search ..... 270/58, 53, 45; 271/221, 222, 198, 210, 185, 288, 287, 293-294; 355/14 SH, 35 H

[56] References Cited

U.S. PATENT DOCUMENTS

| | | | |
|---|---|---|---|
| 3,559,984 | 2/1971 | Westra | 271/221 |
| 3,685,219 | 8/1972 | Palmenberg | 51/328 |
| 3,910,568 | 10/1975 | Brown et al. | 271/221 |
| 3,944,217 | 3/1976 | Greene et al. | 271/198 |
| 3,946,876 | 3/1976 | Jensen | 271/210 |
| 3,995,748 | 12/1976 | Looney | 270/58 |
| 4,047,713 | 9/1977 | Swezlman et al. | 271/221 |
| 4,145,037 | 3/1979 | Mol | 270/58 |
| 4,361,320 | 11/1982 | Kikuchi et al. | 271/288 |
| 4,361,393 | 11/1982 | Noto | 355/35 H |
| 4,405,225 | 9/1983 | Perrault | 355/14 SH |
| 4,408,756 | 10/1983 | Miyashita et al. | 271/288 |
| 4,433,837 | 2/1984 | Romanowski | 371/293 |
| 4,439,865 | 3/1984 | Kikuchi et al. | 355/14 SH |
| 4,444,491 | 4/1984 | Rinehart et al. | 270/53 |
| 4,449,812 | 5/1984 | Furuichi et al. | 355/35 H |
| 4,466,608 | 8/1984 | DuBois et al. | 271/221 X |
| 4,469,323 | 9/1984 | Miyashita et al. | 271/288 |
| 4,473,223 | 9/1984 | Lap | 271/294 |
| 4,501,419 | 2/1985 | Takahashi et al. | 271/288 |
| 4,512,565 | 4/1985 | Matsumoto et al. | 271/288 |
| 4,607,838 | 8/1986 | Matsuyama et al. | 271/221 |

*Primary Examiner*—E. H. Eickholt
*Attorney, Agent, or Firm*—Richard E. Jenkins

[57] ABSTRACT

A blueprint copy collating apparatus for use with a blueprint copying machine comprising a plurality of blueprint receiving bins which are adapted for vertical movement relative to a support frame. A conveyor means is provided for transporting blueprint copies to the blueprint receiving bins and a drive means provided for raising and lowering the bins relative to the conveyor according to a predetermined sequence which is determined by a control circuit and corresponds to user selection. A vibrator table is secured to the apparatus for aligning sets of blueprint copies which are removed from individual bins subsequent to completion of the sorting or stacking function.

17 Claims, 12 Drawing Figures

BLUEPRINT COPY COLLATING APPARATUS

DESCRIPTION

1. Technical Field

This invention relates to a novel blueprint copy sorting apparatus, and more particularly, to a blueprint copy collator suitable for use with or as a part of a conventional blueprint copying machine.

2. Background Art

In the operation of blueprint copying or reproduction machines it is necessary to collate the blueprint copies when they are removed from the copying machine. Up until now this has been a labor intensive project requiring two or more persons working at a large table behind the blueprint copying machine in order to collate the blueprint copies by hand. It is not uncommon that the manual collation would require that 100 stacks of blueprint copies of 100 sheets per stack would be required to be collated by hand into 100 sets of blueprint copies or prints. Thus, a sorting table of 100 feet or more in length is commonly used behind a blueprint copying machine in order to provide sufficient space for manual collation by up to four or more persons. Therefore, it can be fully appreciated that at the present time the collating of blueprint copies made on conventional blueprint reproduction machines is a costly and slow manual operation.

Applicant is not aware of any apparatus for automating the blueprint copy collating process described hereinbefore. A variety of collating apparatus are known for use with plain paper photocopying machines such as those manufactured by Xerox Corporation, Pitney-Bowes and Canon. However, all of the prior art presently known to applicant relates to collators for use with plain paper photocopying machines and is not believed to be relevant to the blueprint copying art and the problems peculiarly inherent thereto.

DISCLOSURE OF THE INVENTION

In accordance with the present invention, applicant provides a novel blueprint copy collating apparatus designed specifically for use with existing blueprint copying machines in order to obviate the need for manual collation techniques presently practiced by those in the blueprint copying business. The instant blueprint copy collating apparatus comprises a print tray or bin array with a plurality of spaced-apart blueprint receiving bins which are vertically movable relative to the frame of the apparatus. A conveyor secured to one side of the apparatus transports blueprint copies from a blueprint copying machine to the blueprint receiving side of the bin array, and drive means is provided for vertically raising and lowering the bin array relative to the conveyor in order that the bins may receive the blueprint copies from the conveyor according to a predetermined sequence determined by an electrically connected control means. A vibrator table is secured to the frame of the collating apparatus to facilitate alignment of blueprint copy sets which are removed from the bin array.

It is therefore a principal object of the present invention to provide a blueprint copy collating apparatus for use with conventional blueprint copying machines in order to reduce the manual labor now required for sorting and stacking.

It is a further object of the present invention to provide an automated blueprint copy collating apparatus which is faster than manual sorting and requires significantly less floor space than sorting tables previously used.

It is also an object of the present invention to provide an automated blueprint copy collating apparatus which will greatly reduce the time previously required for manual sorting.

Some of the objects of the invention having been stated, other objects will become evident as the description proceeds, when taken in connection with the accompanying drawings.

DESCRIPTION OF THE DRAWINGS

FIG. 7 is a perspective view of the vibrator table of the apparatus shown in FIG. 1; and FIG. 7A is a side view of a portion of the vibrator table of the apparatus shown in FIG. 1.

BEST MODE FOR CARRYING OUT THE INVENTION

Figures 1, 1A:
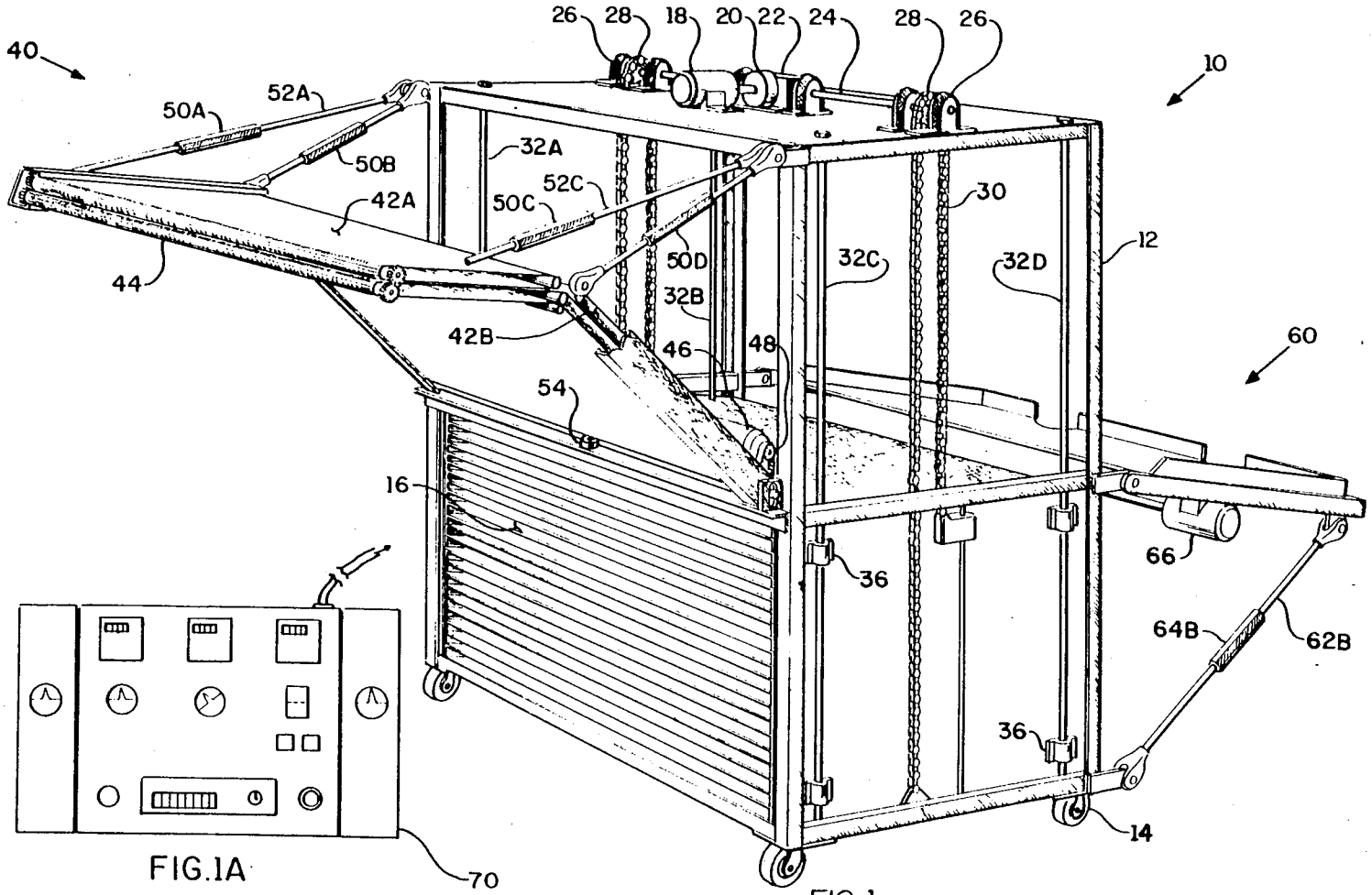
FIG. 1 is a perspective view illustrating the arrangement of the blueprint copy collating apparatus embodying the instant invention.
FIG. 1A is an enlarged view of the control panel for the apparatus shown in FIG. 1.
Figure 2:
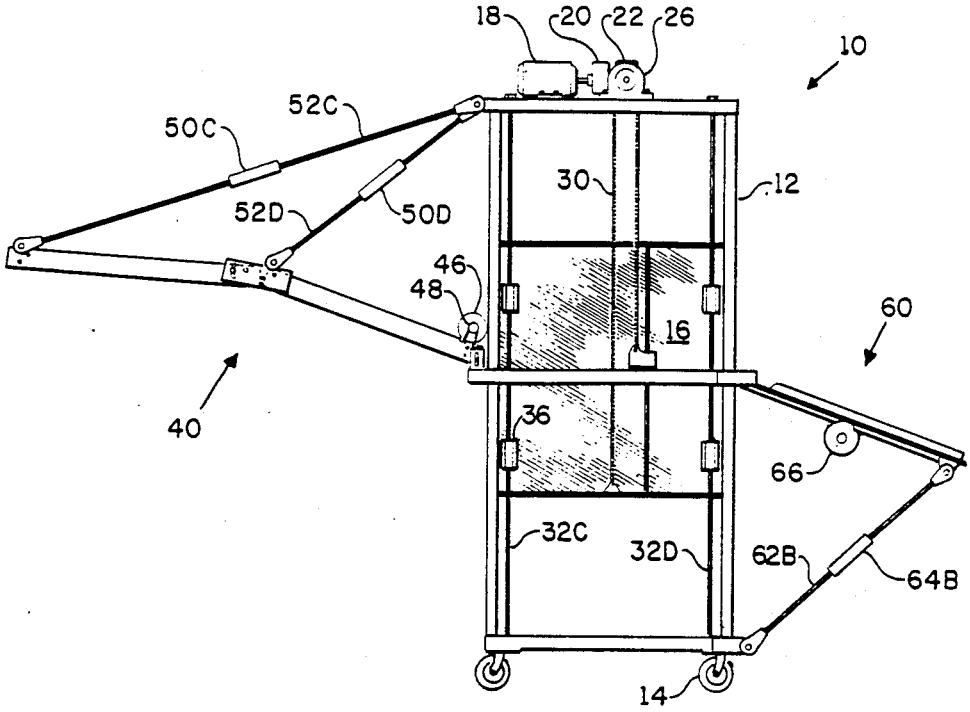
FIG. 2 is a side elevation view of the apparatus shown in FIG. 1.
Figure 3:
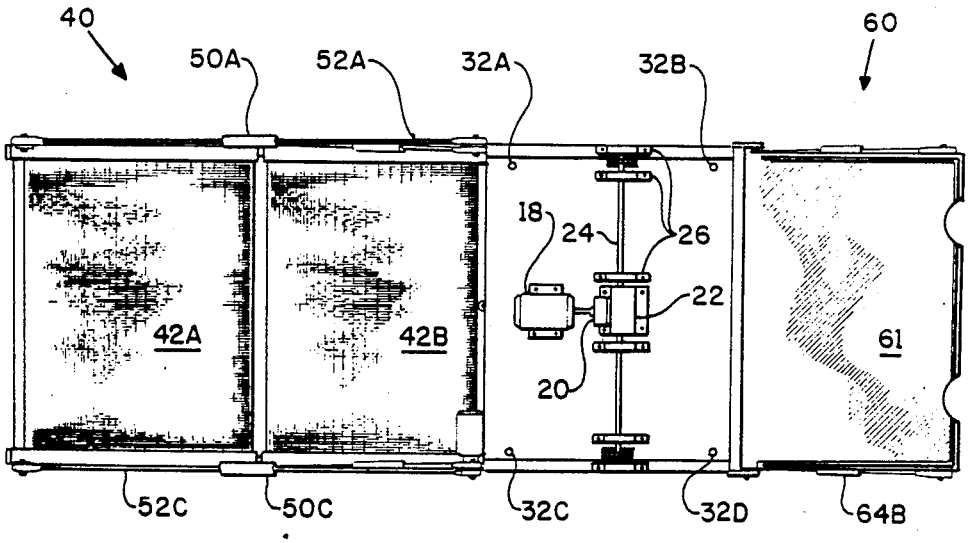
FIG. 3 is a top plan view of the apparatus shown in FIG. 1.

Referring now more specifically to the drawings, and particularly to FIGS. 1–3, the blueprint copy collating apparatus of the present invention is shown and designated generally by the numeral 10. Collating apparatus 10 is intended to be positioned immediately behind a rear delivery blueprint copying machine. Typical but certainly not inclusive of the blueprint copying machines (or dry diazo whiteprinters) with which apparatus 10 may be used are the AM Bruning 748 manufactured by A.M. Bruning of Illinois, the DIETZGEN reproduction machine manufactured by Dietzgen Corporation of Illinois, and the OCE 230-Series diazo printers manufactured by Oce-Industries, Inc. of Illinois. These representative blueprint reproduction or copying machines typically operate at speeds between 30 feet per minute and 75 feet per minute and make blueprint copies in the general size range of 8.5 inches by 11 inches up to 30 inches by 42 inches.

The preferred embodiment of apparatus 10 comprises a frame 12 including rollers 14 secured to the bottom thereof to facilitate portable movement from one blueprint copying machine to another as may be necessary. A vertically stacked array of blueprint receiving bins, generally designated 15, is adapted to be vertically movable within frame 12 in order to receive blueprints from a blueprint copying machine in selected bins 16 according to a predetermined sequence. Bin array 15 includes 30 blueprint receiving bins 16 which are most suitably spaced-apart approximately one inch from each other and are each inclined approximately 3–5 degrees from the blueprint receiving side to the opposing blueprint removal side thereof in order to facilitate retention of blueprint copies deposited therein. Bin array 15 is raised and lowered with a drive means comprising electric motor 18 operatively connected to clutch 20 and double reduction gear assembly 22. A drive shaft 24 extends from gear assembly 22 and is supported by drive shaft bearings 26. A sprocket gear 28 and chain 30 is provided at each end of drive shaft 24 with each chain secured to bin array 15. In this fashion, bin array 15 may be selectively raised or lowered by proper actuation of electric motor 18.

The vertical movement of bin array 15 within frame 12 is guided by guide bars **32*a*–32*d*. As best seen in FIG. 1, opposing sides of apparatus 10 (which are adjacent to the blueprint copy receiving and copy removal sides) are each provided with a pair of vertically extending guide bars secured at the top and bottom thereof to frame 12 of the collating apparatus. Four nylon sleeves 36 are secured at both the top and at the bottom of bin array 15 in order to slidably receive guide bars 32*a*–32*d* and to both guide and stabilize bin array 15 while it is being raised or lowered by electric motor 18**.

Figure 4:
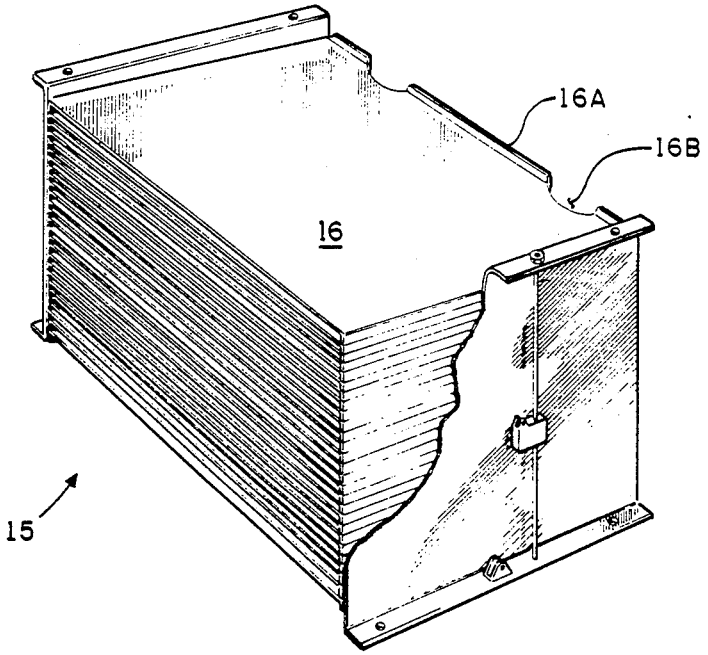
FIG. 4 is a perspective view with parts broken away showing details of the bin array of the apparatus shown in FIG. 1.
Figure 5:
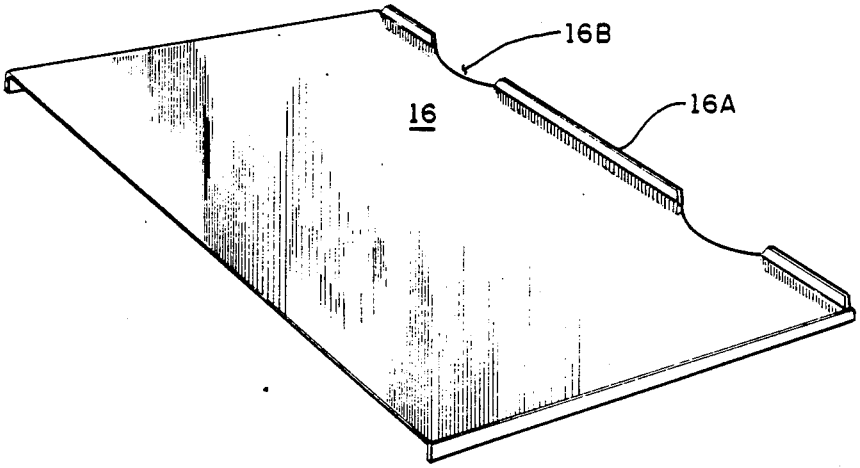
FIG. 5 is a perspective view of a single blueprint receiving bin of the bin array shown in FIG. 4.

With specific reference now to FIGS. 4 and 5, bin 16 can be seen to include a lip **16*a* and a pair of spaced-apart indentations 16*b* along the blueprint copy removal side thereof in order to facilitate receipt and removal of blueprint copies from bin 16. Although any suitably rigid and strong material could be utilized, applicant's preferred embodiment of the present invention contemplates that bin array 15 will be constructed of lightweight plastic so as to minimize the load on electric motor 18. Also, each bin 16** will measure 32 inches by 48 inches in order to accommodate all standard blueprint copy sizes.

Figures 6, 6A, 6B, 6C:
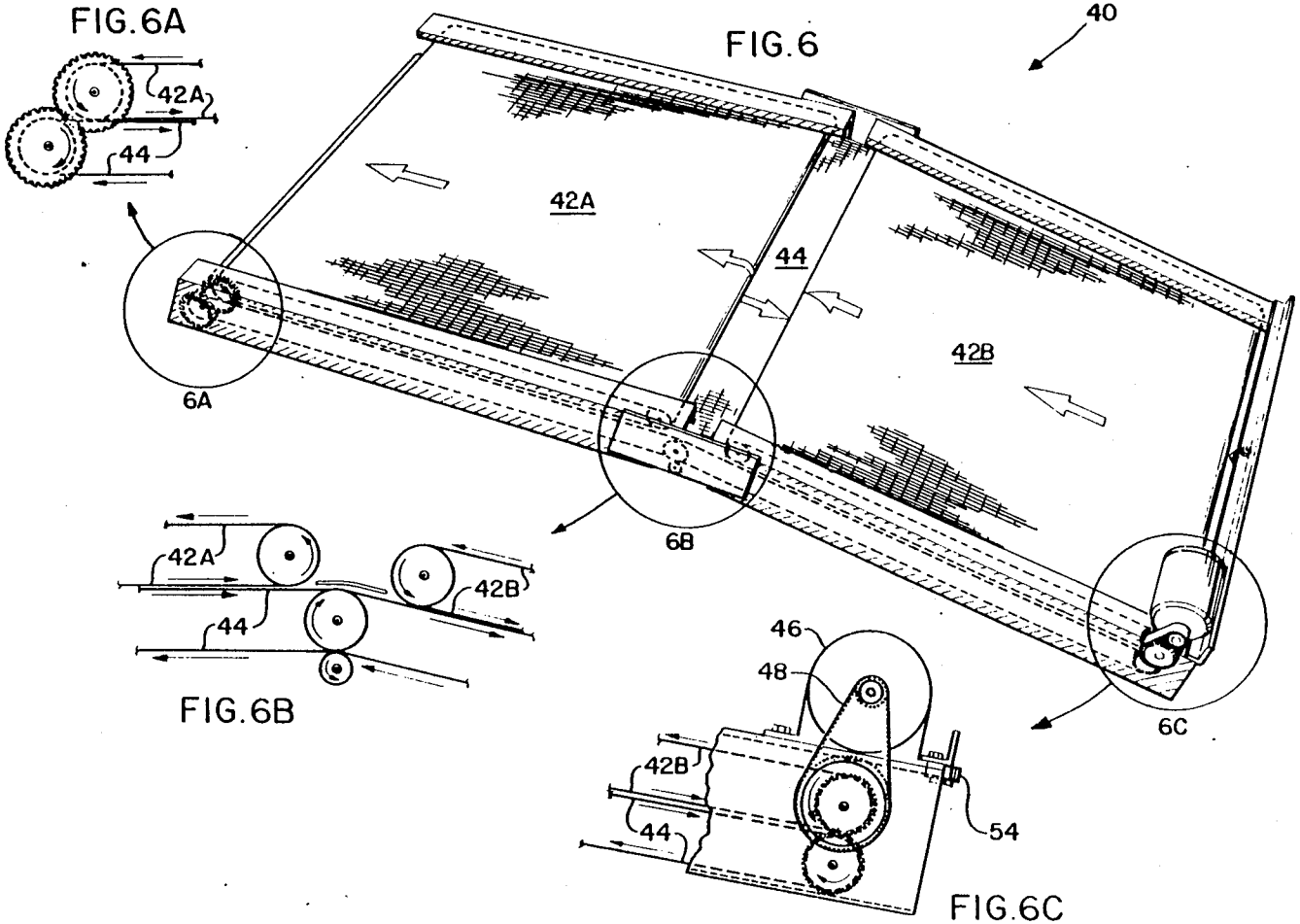
FIG. 6 is a perspective view showing the conveyor mechanism for the apparatus shown in FIG. 1.
FIG. 6A is a side view of the top and lower belts at the remote end of the conveyor.
FIG. 6B is a side view of the top and lower belts at the medial portion of the conveyor.
FIG. 6C is a side view of the drive assembly for the top and lower belts of the conveyor.

Referring now to FIG. 6 with reference as needed to FIG. 1, the preferred embodiment of collating apparatus 10 further comprises a conveyor 40 which is pivotably mounted to frame 12 on the blueprint copy receiving side of collating apparatus 10. Conveyor 40 comprises top conveyor belts **42*a*, 42*b* which are vertically opposed along substantially the entire length thereof by lower conveyor belt 44. An electric drive motor 46 through any suitable conventional type belt and pulley arrangement 48 drives conveyor belts 42*a*, 42*b* and 44 in the direction of movement indicated by the arrows in order to transport blueprint copies from the remote end of conveyor 40 and between top conveyor belts 42*a*, 42*b* and lower conveyor belt 44 to a blueprint receiving bin 16 within bin array 15. The remote end of conveyor 40 may be vertically adjusted with turnbuckles 50*a*–50*d* on support arms 52*a*–52*d* in order to assure that the remote end of conveyor 40 is in proper position behind a rear delivery blueprint copying machine so as to engage the blueprint copy as it exits the blueprint copying machine. The speed of conveyor drive motor 46 may be adjusted as necessary to control the linear speed of conveyor belts 42*a*, 42*b* and 44 in order to accommodate a blueprint copying machine speed range of about 10 feet to 75 feet per minute. A photo electric sensor 54 is secured to the frame of conveyor 40 adjacent the blueprint copy exit end thereof (see FIG. 6*c*) and positioned so as to count the trailing edge of each blueprint copy as it departs conveyor 40 and is received by a bin 16 of bin array 15. Sensor 54** is electrically connected to the control circuit which will be discussed in more detail below.

Collating apparatus 10 also includes an attached vibrator table 60 (see FIG. 7). Vibrator table 60 comprises two support arms **62*a*, 62*b* which include turnbuckles 64*a*, 64*b*, respectively. An electric motor 66 and conventional type eccentric pin vibrator assembly 68 is operatively secured to the surface of vibrator table 60 to provide the necessary vibratory action. The vibrator table surface 61 is movably secured to frame 63 of vibrator table 60 with slots 65 and corresponding guide pins 67. The angle of inclination of the surface of vibrator table 60 may be adjusted with turnbuckles 64*a*, 64*b*** as is desired for the convenience of the user in aligning blueprint copy sets for stapling or other subsequent processing.

A remote control panel 70 is shown in FIG. 1, but it should be appreciated that this panel may also be secured to collating apparatus 10 as a matter of design choice. Control panel 70 is electrically connected to conventional electrical control circuitry (not shown) and to photo electric sensor 54. Control panel 70 allows the user to independently vary the linear speed of conveyor 40 and the vertical movement speed of bin array 15. Three digital counters and a sort/stack button are provided for sorting or stacking as will be described hereinafter. A forth digital counter is provided which will provide the cumulative number of copies received by bin array 15 and includes a key reset. Finally, a bin array reset button and automatic versus manual control switch for the apparatus are provided. It will be appreciated, of course, that other control systems could be utilized by the instant invention.

In operation, conveyor 40 of blueprint copy collating apparatus 10 is positioned immediately behind the rear delivery of a blueprint copying machine. This is easy to accomplish in view of the portability provided to apparatus 10 by rollers 14. The power to apparatus 10 is turned on at control panel 70 and either the sort or stack function selected. Assuming that the sort function has been selected and the automatic switch activated, the user will then select a number on counter one to correspond to the number of sets of blueprint copies to be created. Then another number is selected on counter two to indicate the total number of copies per set. For purposes of example, assume 10 sets is selected for counter one (which can accommodate up to 30 sets in bin array 15) and 20 blueprint copies per set is selected on counter two. Bin array 15 will be driven vertically downwardly to its starting position by electric motor 18 so that the uppermost blueprint copy receiving bin 16 is positioned adjacent the exit end of conveyor 40 in order to receive the first blueprint copy therein. As the blueprint copy exits conveyor 40 and enters bin 16 it is counted by photo electric sensor 54 which causes counter one to count down from 10 to 9 while counter two still indicates 1. Electric motor 18 now elevates bin array 15 so that the second blueprint copy is received in the second bin 16 of bin array 15. Counter one now indicates 8 and counter two still indicates 1. This process will be repeated until counter one is down to its lowest digit 0 and at this time bin array 15 will be returned to its starting position and counter one will again read 10 and counter two will now read 2. This process will be repeated until counter two is satisfied by a reading of 20 which indicates that each of the top 10 bins of bin array 15 contains a collated or sorted set of 20 copies. If necessary, the speed of electric motor 18 which drives bin array 15 may be adjusted so as to better correspond to the linear speed of conveyor 40. When all copies have been collated, a print set is removed from one of the 10 bins and individually placed on vibrator table 60 which is being agitated by electric motor 66 in order to bring the 20 prints of the set into alignment. Then the print set may be stapled or otherwise secured together and the next set removed from the bin array for alignment and stapling. In this fashion, a sorting job which may have previously required several workers a number of hours to accomplish may now be performed by the operator of the copying machine in only a matter of minutes.

The stacking function of apparatus 10 operates in a similar fashion. For example, if 5 sets containing 5 copies per set are required, the select switch of control panel 70 is set to stack and counter one set to 5 and counter three set to 5. Bin array 15 will again be driven to the starting position at the bottom of its vertical pathway with uppermost bin 16 in registration with the exit end of conveyor 40. For this function, 5 sheets will be placed into the first bin of print tray 15 as they are counted by photo electric sensor 54 and counter one counts down from 5 to 0. Print tray 15 will then be elevated one space by electric motor 18 in order that the second blueprint receiving bin be readied to receive blueprint copies. Counter three, of course, now registers 2. This process will be repeated until 5 sets show on counter three.

Although the sort and stack functions have been described generally hereinabove, it should be appreciated that they are performed while the automatic/-manual switch on control panel 70 indicates automatic. When the control switch is set in the manual position, bin array 15 may now be controlled by an up/down switch which provides for movement of bin array 15 up or down one space each time the switch is actuated.

The digital totalizer on control panel 70 keeps an aggregate count of each blueprint copy which has been counted by photo electric sensor 54 and is provided with a key reset. It is contemplated that the totalizer counter will have a 40 day memory function.

While the invention has been described with reference to the structure disclosed, it is not confined to the details set forth, but is intended to cover such modifications or changes as may come within the scope of the following claims.

What is claimed is:

1. A blueprint copy collating apparatus for use with a blueprint copying machine and comprising:

a frame;

a bin array comprising a plurality of vertically spaced-apart blueprint receiving bins each having a blueprint receiving side and a blueprint removal side, said bin array adapted for being vertically movable relative to said frame;

conveyor means secured to said frame for transporting blueprint copies from a blueprint machine to the blueprint receiving side of said bin array;

drive means for vertically raising and lowering said bin array relative to said conveyor means according to a predetermined sequence in order that said blueprint receiving bins may receive blueprint copies from said conveyor means according to the predetermined sequence;

control means electrically connected to said drive means for controlling the sequence in which blueprint copies are received in said bins according to a predetermined selection by a user of said collating apparatus; and vibrator table means secured to said frame for vibrating a plurality of blueprint copies removed from said bin array in order to align the blueprint copies.

2. A blueprint collating apparatus according to claim 1 wherein said frame includes rollers secured to the bottom thereof so as to allow said apparatus to be easily moved from one blueprint copying machine to another as desired.

3. A blueprint collating apparatus according to claim 1 wherein said plurality of bins are each inclined downwardly from said blueprint receiving side to said blueprint removal side.

4. A blueprint collating apparatus according to claim 3 wherein said plurality of bins comprises 30 bins.

5. A blueprint collating apparatus according to claim 1 wherein said conveyor means comprises a drive motor and at least two vertically opposing endless belts for engaging blueprint copies therebetween and conveying the blueprint copies to said collating apparatus.

6. A blueprint collating apparatus according to claim 1 wherein said conveyor means comprises as least one pivotally articulated joint to enable said conveyor to be adjustably positioned at the blueprint copy delivery end of the blueprint copying machine.

7. A blueprint collating apparatus according to claim 1 wherein said drive means comprises a motor and gear assembly secured to the top of said frame, said motor and gear assembly being operatively connected to at least one sprocket and chain wherein said chain is secured at one end thereof to said bin array.

8. A blueprint collating apparatus according to claim 7 wherein said gear assembly is operatively connected to a spaced-apart pair of sprockets and chains.

9. A blueprint collating apparatus according to claim 8 wherein said bin array includes a plurality of sleeves secured to each of two opposing sides of said bin array and adapted to travel on a plurality of corresponding vertical guide bars so as to guide said bin array during vertical movement by said drive means.

10. A blueprint collating apparatus according to claim 1 wherein said control means is adapted to provide for use of any predetermined number of said plurality of blueprint receiving bins according to a user determined sequence and includes sensor means for counting each blueprint copy as it is transported by said conveyor means to a respective one of said blueprint receiving bins.

11. A blueprint collating apparatus according to claim 10 wherein said sensor means comprises at least one photo electric cell.

12. A blueprint collating apparatus according to claim 1 wherein said vibrator table means includes a motor and cam assembly secured thereto for vibrating the top surface of said table.

13. A blueprint copy collating apparatus for use with a blueprint copying machine and comprising:

a frame;

a bin array comprising a plurality of vertically spaced-apart blueprint receiving bins each having a blueprint receiving side and a blueprint removal side, said bin array adapted for being vertically movable relative to said frame on a plurality of vertically extending guide bars;

a conveyor secured at one end to said frame and comprising a plurality of vertically opposed endless belts for engaging the blueprint copies between said belts and transporting the blueprint copies from the blueprint copying machine to the blueprint receiving side of said bin array;

a motor and gear assembly secured at the top of said frame and including an operatively connected plurality of sprockets and chains for vertically raising and lowering said bin array relative to said conveyor according to a predetermined sequence in order that said blueprint receiving bins may receive blueprint copies from said conveyor according to the predetermined sequence;

control means electrically connected to said motor for controlling the sequence in which the copies are received in said bins according to a user determined sequence and including a photocell sensor for counting the blueprint copies transported by said conveyor; and a vibrator table secured to said frame and including a motor and cam assembly for vibrating a plurality of blueprint copies removed from said bin array and placed thereon in order to align the copies.

14. A blueprint collating apparatus according to claim 13 wherein said frame includes rollers secured to the bottom thereof.

15. A blueprint collating apparatus according to claim 13 wherein said bin array comprises 30 bins with each of said bins being inclined downwardly from said blueprint receiving side to said blueprint removal side at an angle of about 3 to 5 degrees below horizontal.

16. A blueprint collating apparatus according to claim 13 wherein said bin array includes a plurality of sleeves secured to each of two opposing sides thereof and adapted to travel on said vertical guide bars so as to guide said bin array during vertical movement thereof.

17. A blueprint collating apparatus according to claim 13 wherein said conveyor comprises a drive motor and at least one pivotally articulated joint to enable said conveyor to be adjustably positioned at the blueprint copy delivery end of the blueprint copying machine.

* * * * *

UNITED STATES PATENT AND TRADEMARK OFFICE

CERTIFICATE OF CORRECTION

PATENT NO. : 4,700,940

DATED : October 20, 1987

INVENTOR(S) : Theodas C. King

It is certified that error appears in the above-identified patent and that said Letters Patent is hereby corrected as shown below:

In the drawings add Figure 7 as shown on the attached sheet.

Signed and Sealed this

Third Day of July, 1990

*Attest:*

HARRY F. MANBECK, JR.

*Attesting Officer*

*Commissioner of Patents and Trademarks*

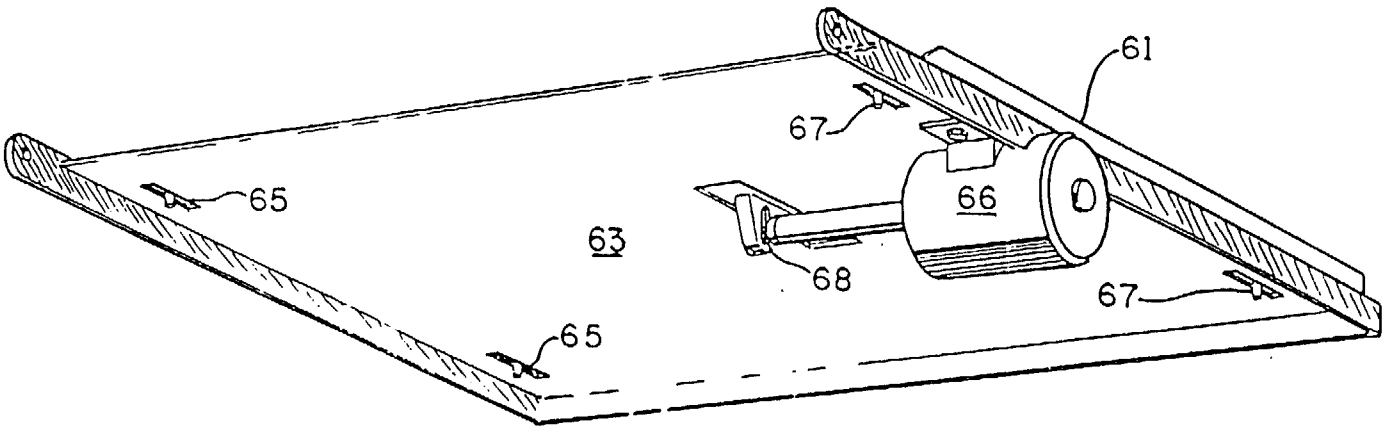
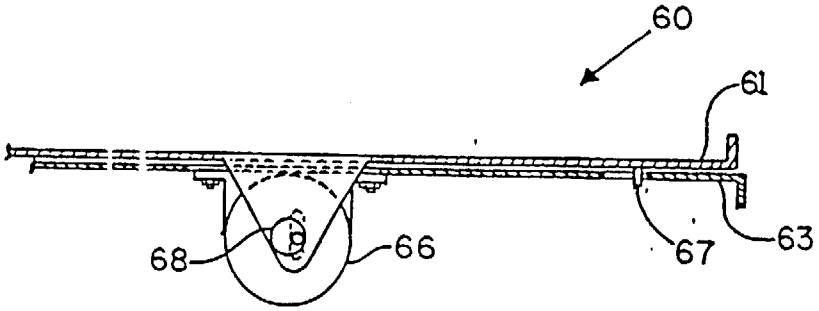
FIG. 7A
FIG. 7